US011441555B2

(12) United States Patent
Tanaka

(10) Patent No.: US 11,441,555 B2
(45) Date of Patent: Sep. 13, 2022

(54) PUMP

(71) Applicant: Murata Manufacturing Co., Ltd., Kyoto (JP)

(72) Inventor: Nobuhira Tanaka, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 17 days.

(21) Appl. No.: 17/182,337

(22) Filed: Feb. 23, 2021

(65) Prior Publication Data

US 2021/0199105 A1 Jul. 1, 2021

Related U.S. Application Data

(63) Continuation of application No. PCT/JP2019/046178, filed on Nov. 26, 2019.

(30) Foreign Application Priority Data

Nov. 27, 2018 (JP) ..... JP2018-221453

(51) Int. Cl.
*F04B 45/047* (2006.01)
*F04B 43/04* (2006.01)
*F04B 43/09* (2006.01)

(52) U.S. Cl.
CPC ..... *F04B 45/047* (2013.01); *F04B 43/046* (2013.01); *F04B 43/095* (2013.01)

(58) Field of Classification Search
CPC ..... F04B 43/046; F04B 43/095; F04B 45/047
See application file for complete search history.

(56) References Cited

U.S. PATENT DOCUMENTS

2009/0087323 A1 4/2009 Blakey et al.
2013/0266461 A1 10/2013 Hirata et al.
2013/0280105 A1 10/2013 Locke et al.
(Continued)

FOREIGN PATENT DOCUMENTS

JP 2008-537057 A 9/2008
JP 2012-528980 A 11/2012
(Continued)

OTHER PUBLICATIONS

Written Opinion for PCT/JP2019/046178 dated Feb. 18, 2020.
International Search Report for PCT/JP2019/046178 dated Feb. 18, 2020.

*Primary Examiner* — Charles G Freay
(74) *Attorney, Agent, or Firm* — Pearne & Gordon LLP

(57) ABSTRACT

A pump includes a vibrating plate having a piezoelectric body on a first main surface, a cover including a top panel and a side wall, the top panel opposing a second main surface of the vibrating plate opposite to the first main surface, the top panel having a first cavity, and the side wall being connected to an outer peripheral portion of the top panel to surround a space between the top panel and the vibrating plate, a support portion connected to the side wall and supporting an outer periphery of the vibrating plate, and a second cavity formed between the side wall and the vibrating plate in a cross-sectional view in a direction orthogonal to a direction in which the second main surface of the vibrating plate and a main surface of the top panel oppose each other.

20 Claims, 11 Drawing Sheets

(56) References Cited

U.S. PATENT DOCUMENTS

| | | | | |
|---|---|---|---|---|
| 2020/0370544 | A1 | 11/2020 | Tanaka | |
| 2021/0095659 | A1 * | 4/2021 | Kawabata | F04B 45/047 |

FOREIGN PATENT DOCUMENTS

| | | | |
|---|---|---|---|
| JP | 5177331 | B1 | 4/2013 |
| WO | 2013117945 | A1 † | 8/2013 |
| WO | 2019/159448 | A1 | 8/2019 |

* cited by examiner
† cited by third party

PUMP

This is a continuation of International Application No. PCT/JP2019/046178 filed on Nov. 26, 2019 which claims priority from Japanese Patent Application No. 2018-221453 filed on Nov. 27, 2018. The contents of these applications are incorporated herein by reference in their entireties.

BACKGROUND OF THE DISCLOSURE

Field of the Disclosure

The present disclosure relates to a pump, and particularly to a pump including a piezoelectric body.

Description of the Related Art

A pump including a piezoelectric body has been used as a suction device or a pressure device that sucks or pressurizes a fluid such as a gas or a liquid. Examples of a pump include a pump that at least partially implements the functions of a valve that closes an air inlet or an air outlet continuous with a pump chamber with vibrations of a vibrating plate.

For example, Patent Document 1 describes a pump that does not include a valve. The pump intakes and exhausts air with vibrations of a vibrating plate to which a piezoelectric body is bonded.

Patent Document 1: Japanese Patent No. 5177331

BRIEF SUMMARY OF THE DISCLOSURE

However, a pump that at least partially implements the functions of a valve with vibrations of a vibrating plate fails to obtain a sufficient pump flow rate or pump pressure, and thus fails to exert the sufficient pump performance.

An object of the present disclosure is to provide a pump including a piezoelectric body with improved performance.

To achieve the above object, an aspect of the present disclosure provides a pump that includes a vibrating plate having a piezoelectric body on a first main surface, a cover including a top panel and a side wall, the top panel opposing a second main surface of the vibrating plate opposite to the first main surface, the top panel having a first cavity, and the side wall being connected to an outer peripheral portion of the top panel to surround a space between the top panel and the vibrating plate, a support portion connected to the side wall and supporting an outer periphery of the vibrating plate, and a second cavity provided between the side wall and the vibrating plate in a cross-sectional view in a direction orthogonal to a direction in which the second main surface of the vibrating plate and a main surface of the top panel oppose each other. The first cavity in the top panel is located to oppose a portion of the vibrating plate having a displacement amount smaller than a displacement amount of an outer peripheral edge of the vibrating plate.

The present disclosure can provide a pump including a piezoelectric body and having improved pump performance.

DETAILED DESCRIPTION OF THE DISCLOSURE

Figure 1:
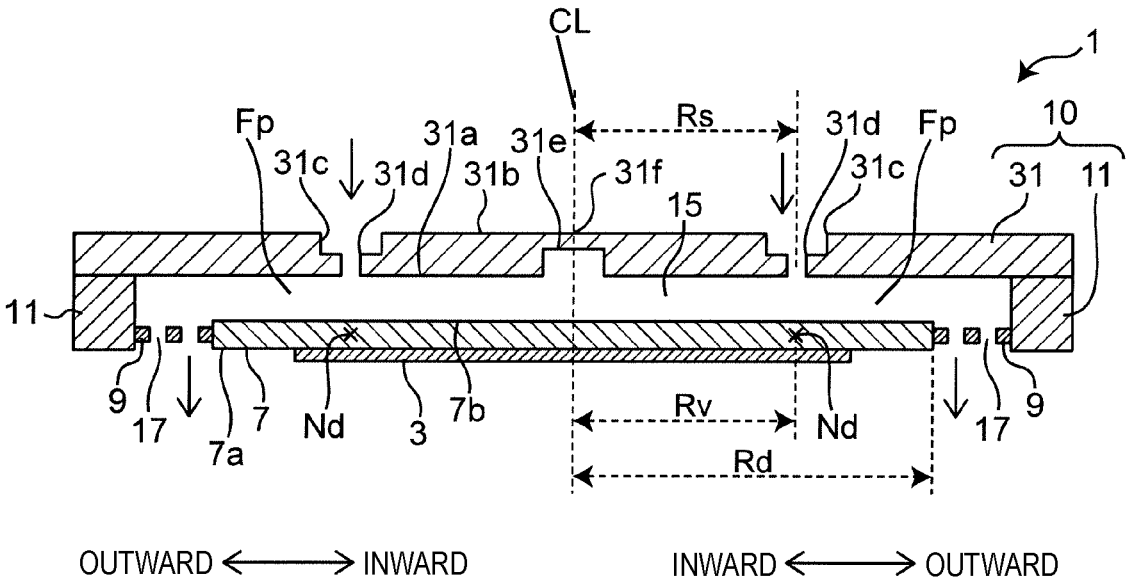
FIG. 1 is a schematic cross-sectional view of a pump according to Embodiment 1.

A pump according to an aspect of the present disclosure includes a vibrating plate having a piezoelectric body on a first main surface, a cover including a top panel and a side wall, the top panel opposing a second main surface of the vibrating plate opposite to the first main surface, the top panel having a first cavity, and the side wall being connected to an outer peripheral portion of the top panel to surround a space between the top panel and the vibrating plate, a support portion connected to the side wall and supporting an outer periphery of the vibrating plate, and a second cavity formed between the side wall and the vibrating plate in a cross-sectional view in a direction orthogonal to a direction in which the second main surface of the vibrating plate and a main surface of the top panel oppose each other. The first cavity in the top panel is located to oppose a portion of the vibrating plate having a displacement amount smaller than a displacement amount of an outer peripheral edge of the vibrating plate.

In this structure, the outer peripheral edge of the vibrating plate has a large displacement, so that a fluid flows at a high speed at the outer peripheral edge of the vibrating plate. In contrast, at the portion of the vibrating plate having a displacement amount smaller than the displacement amount of the outer peripheral edge of the vibrating plate, the fluid flows at a lower speed than at the outer peripheral edge. Thus, the static pressure differs between the outer peripheral edge of the vibrating plate and the portion of the vibrating plate having a smaller displacement amount than that at the outer peripheral edge, and the static pressure is lower at the outer peripheral edge. The cavities in the top panel oppose the portion of the vibrating plate having a smaller displacement amount than the displacement amount of the outer peripheral edge of the vibrating plate. Thus, the static pressure is lower at the outer peripheral edge of the vibrating plate than at the cavities in the top panel, so that the fluid flows outward from the cavities in the top panel to the outer peripheral edge of the vibrating plate. Thus, the pump can improve its performance.

The vibrating plate may vibrate in opposite phases at the center portion and the outer peripheral edge. The first cavities in the top panel may be located closer to the portion of the vibrating plate serving as the vibration node than to the outer peripheral edge of the vibrating plate. In this structure, the center portion and the outer peripheral edge of the vibrating plate vibrate in opposite phases, so that a portion of the vibrating plate that serves as the node that does not vibrate is located between the center portion and the outer peripheral edge. This portion of the vibrating plate serving as the node has substantially zero displacement amount, and the fluid has the lowest speed at this portion. Since the cavities in the top panel are located closer to the portion of the vibrating plate serving as the vibration node than to the outer peripheral edge of the vibrating plate, a large static pressure difference can be generated between the cavities in the top panel and the outer peripheral edge of the vibrating plate, so that the fluid can flow outward at a higher flow rate from the cavities in the top panel toward the outer peripheral edge of the vibrating plate.

The first cavities in the top panel may be located inward from the portion of the vibrating plate serving as the vibration node. This structure can achieve high pressure characteristics because of the long distance between the cavities in the top panel and the outer peripheral edge of the vibrating plate.

The vibrating plate may have a circular shape, and the center portion and the outer peripheral edge of the vibrating plate may vibrate in opposite phases. The portion of the vibrating plate having a smaller displacement amount than the displacement amount of the outer peripheral edge of the vibrating plate may be located at a position equal to or more than 45% and equal to or less than 81% of the radius of the vibrating plate away from the center CL of the vibrating plate. In this structure, the cavities in the top panel are located adjacent to the node in the Bessel function of the first kind, so that this structure can produce a large static pressure difference.

The support portion may have a beam shape extending along the outer peripheral edge of the vibrating plate. In this structure, the support portion can preferably enhance the flexibility further than the vibrating plate.

The support portion may have greater flexibility than the vibrating plate. In this structure, the outer peripheral edge of the vibrating plate increases its displacement amount, so that this structure can enhance the back-flow prevention effect, and thus enhance the pump flow rate and the pump pressure.

The support portion may be connected to the outer periphery of the vibrating plate throughout. This structure can improve the connection strength between the vibrating plate and the support portion, and thus can improve the durability of the support portion.

The support portion may be thinner than the vibrating plate. In this structure, the support portion formed from, for example, the same material as the vibrating plate can preferably have higher flexibility than the vibrating plate.

The vibrating plate may be formed from a metal, and the support portion may be formed from a resin. In this structure, the support portion can preferably have higher flexibility than the vibrating plate.

The pump may include a valve having a first portion connected to the outer peripheral edge of the vibrating plate and a second portion serving as an open end. In this structure, the second portion of the valve serves as an open end. Thus, when a fluid flows backward through the cavities in the support portions, the open end of the valve stands erect toward the top panel, so that the flow path extending from the cavities in the top panel toward the cavities in the support portions can be narrowed. This structure can thus increase the flow path resistance against the back-flow of the fluid, so that the valve can reduce the back-flow of the fluid. When a fluid flows from the cavities in the top panel to the cavities in the support portions, the second portion of the valve that is apart from the top panel does not prevent the flow of the fluid.

A recess may be located outward from the first cavities in the top panel. This structure can reduce the air resistance of a fluid flowing from the outside to the cavities in the top panel without disturbing the air current inside the cavities.

A hollow may be formed at the center portion of the top panel in the surface facing the vibrating plate. In this structure, the distance between the vibrating plate and the top panel at the center portion of the vibrating plate having the largest vibration displacement is longer than the distance at the other portion. This structure can thus reduce the air resistance and increase the vibration displacement. Thus, the pump flow rate and the pump pressure can be increased.

An auxiliary plate may be held between the vibrating plate and the piezoelectric body. In this structure, the vibrations of the vibrating plate can be further amplified. Thus, the static pressure difference can be increased, and the pump flow rate and the pump pressure can be enhanced.

A pump according to the present disclosure will be described below with reference to the drawings. In the drawings, components with substantially the same function or structure may be denoted with the same reference signs without being described in the description. For ease of understanding of the drawings, the components are mainly and schematically illustrated.

Embodiments described below are mere examples of the present disclosure. However, the present disclosure is not limited to these embodiments. In the embodiments described below, specific numerical values, shapes, components, steps, or order of steps are described as mere examples, and they are not limiting the present disclosure. Among the components of the embodiments below, components not described in an independent claim representing the superordinate concept are described as optional components. This applies to components in modification examples of all the embodiments. Components described in any two or more of the modification examples may be combined to together.

Embodiment 1

Firstly, with reference to FIG. 1, a structure of a pump 1 according to Embodiment 1 will be schematically described. FIG. 1 is a schematic cross-sectional view of a pump 1 according to Embodiment 1. In the following description, air is taken as an example of a fluid that is caused to flow by the pump 1. Instead, the fluid may be a gas other than air or a liquid.

The pump 1 includes a piezoelectric body 3, a vibrating plate 7, support portions 9 that support the vibrating plate 7 while allowing the vibrating plate 7 to vibrate, and a cover 10 that surrounds the space between itself and the vibrating plate 7. The cover 10 includes a side wall 11 to which the outer ends of the support portions 9 are connected, and a top panel 31 connected to an upper end of the side wall 11.

The piezoelectric body 3 is composed of a thin plate formed from a piezoelectric material and having electrodes disposed on both main surfaces. The piezoelectric body 3 includes electrode films not illustrated over substantially the entire upper and lower main surfaces. The piezoelectric body 3 has a disk shape, and is bonded to the lower surface of the vibrating plate 7 at the center portion.

The vibrating plate 7 is formed from, for example, a metal such as SUS301. The vibrating plate 7 has a first main surface 7*a* on which the piezoelectric body 3 is connected. Across the electrode films on the upper and lower main surfaces of the piezoelectric body 3, for example, a square-wave or sine-wave driving voltage of approximately 20 kHz is applied from an external power supply. Thus, the vibrating plate 7 and the piezoelectric body 3 cause bending vibrations in a direction normal to the main surfaces serving as an amplitude direction in a rotation symmetry shape (in a concentric shape) from the center to the outer periphery of the main surfaces.

The top panel 31 has a first main surface 31*a* opposing the vibrating plate 7, a second main surface 31*b* opposite to the first main surface 31*a*, an annular recess 31*c* formed in the second main surface 31*b*, and multiple first cavities 31*d* arranged annularly and extending through from the bottoms surface of the recess 31*c* to a pump chamber 15. The top panel 31 also includes a cylindrical hollow 31*e* recessed at the center portion in the first main surface 31*a* toward the second main surface 31*b*. The top panel 31 is symmetrical about a symmetric point 31*f*, with no first cavities 31*d* at the symmetric point 31*f*. The symmetric point 31*f* is located at the position opposing a center CL of the vibrating plate 7 of the top panel 31, and, for example, at the center of the top panel 31. FIG. 1 is a cross-sectional view in the direction orthogonal to the direction in which the first main surface 31*a* of the top panel 31 and the second main surface 31*b* of the vibrating plate 7 oppose each other.

The side wall 11 is connected to the outer peripheral portion of the top panel 31 to surround the pump chamber 15 on the surface of the top panel 31 facing the vibrating plate 7. The side wall 11 has, for example, a cylindrical shape. Thus, the cover 10 opposes the surface of the vibrating plate 7 opposite to the first main surface 31*a*, has the first cavities 31*d*, and is connected to the outer peripheral portion of the vibrating plate 7 with the support portions 9 interposed therebetween. The top panel 31 and the side wall 11 may be separate components or an integrated unit to form the cover 10.

Between the vibrating plate 7 and the side wall 11, second cavities 17 that connect the pump chamber 15 to the external space closer to the piezoelectric body 3 are formed. Thus, the air sucked from the first cavities 31*d* in the top panel 31 to the pump chamber 15 flows out from the second cavities 17.

Figure 2:
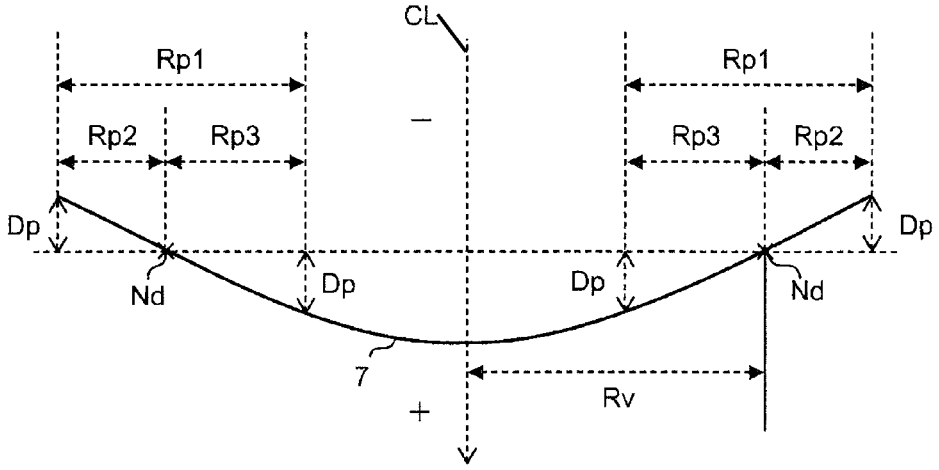
FIG. 2 is a diagram illustrating vibration characteristics of a vibrating plate.

Subsequently, with reference to FIGS. 1 and 2, the relationship between a radius Rd of the vibrating plate 7, a distance Rs from the center CL of the pump 1 and the vibrating plate 7 to the first cavities 31*d* in the top panel 31, and a distance Rv from the center CL of the vibrating plate 7 to a vibration node Nd of the vibrating plate 7 will be described. FIG. 2 is a diagram illustrating the vibration characteristics of the vibrating plate 7. In FIG. 2, a downward displacement of the vibrating plate 7 is defined as a positive displacement, and an upward displacement of the vibrating plate 7 is defined as a negative displacement.

The first cavities 31*d* in the top panel 31 are located to oppose the portion of the vibrating plate 7 that has a smaller displacement amount than a displacement amount Dp of the vibrating plate 7 at the outer peripheral edge. In a plan view, the first cavities 31*d* in the top panel 31 are formed within a range Rp1 of the displacement amount of the vibrating plate 7 smaller than the displacement amount Dp of the vibrating plate 7 at the outer peripheral edge. More specifically, the first cavities 31*d* are formed within a distance Rv that is 63%±18% of the radius Rd from the center of the pump chamber 15 (center CL of the vibrating plate 7). The pressure distribution in the pump chamber 15 is assumed to be in accordance with the Bessel function of the first kind. Thus, the range of the distance Rv from the center of the pump chamber 15 is approximate to the node of the pressure distribution of the pump chamber 15. Here, the portion of the vibrating plate 7 serving as the vibration node Nd and the node of the pressure change of the pump chamber 15 are assumed to coincide with each other. Thus, the fluid is prevented from leaking from the first cavities 31*d*, so that a high pump flow rate and pump pressure can be obtained.

The first cavities 31*d* in the top panel 31 may be formed in a range Rp2 located outward from the portion of the vibrating plate 7 serving as the vibration node Nd in the direction along the first and second main surfaces 7*a* and 7*b*. The first cavities 31*d* in the top panel 31 are formed between the vibration node Nd of the vibrating plate 7 and the outer peripheral edge of the vibrating plate 7 serving as a vibration anti-node. In other words, the first cavities 31*d* in the top panel 31 are located within the range where the sign of a displacement of the vibrating plate 7 and the sign of the value obtained by differentiating a displacement of the vibrating plate 7 coincide with each other.

Alternatively, the first cavities 31*d* in the top panel 31 may be located in the portion of the vibrating plate 7 having a smaller displacement amount than the displacement amount Dp of the vibrating plate 7 at the outer peripheral edge, within a range Rp3 that is located inward from the portion of the vibrating plate 7 serving as the vibration node Nd in the direction along the first and second main surfaces 7*a* and 7*b*. Here, the distance between the first cavities 31*d* in the top panel 31 and the outer peripheral edge of the vibrating plate 7 is long, and thus high pressure characteristics can be obtained.

Figure 3:
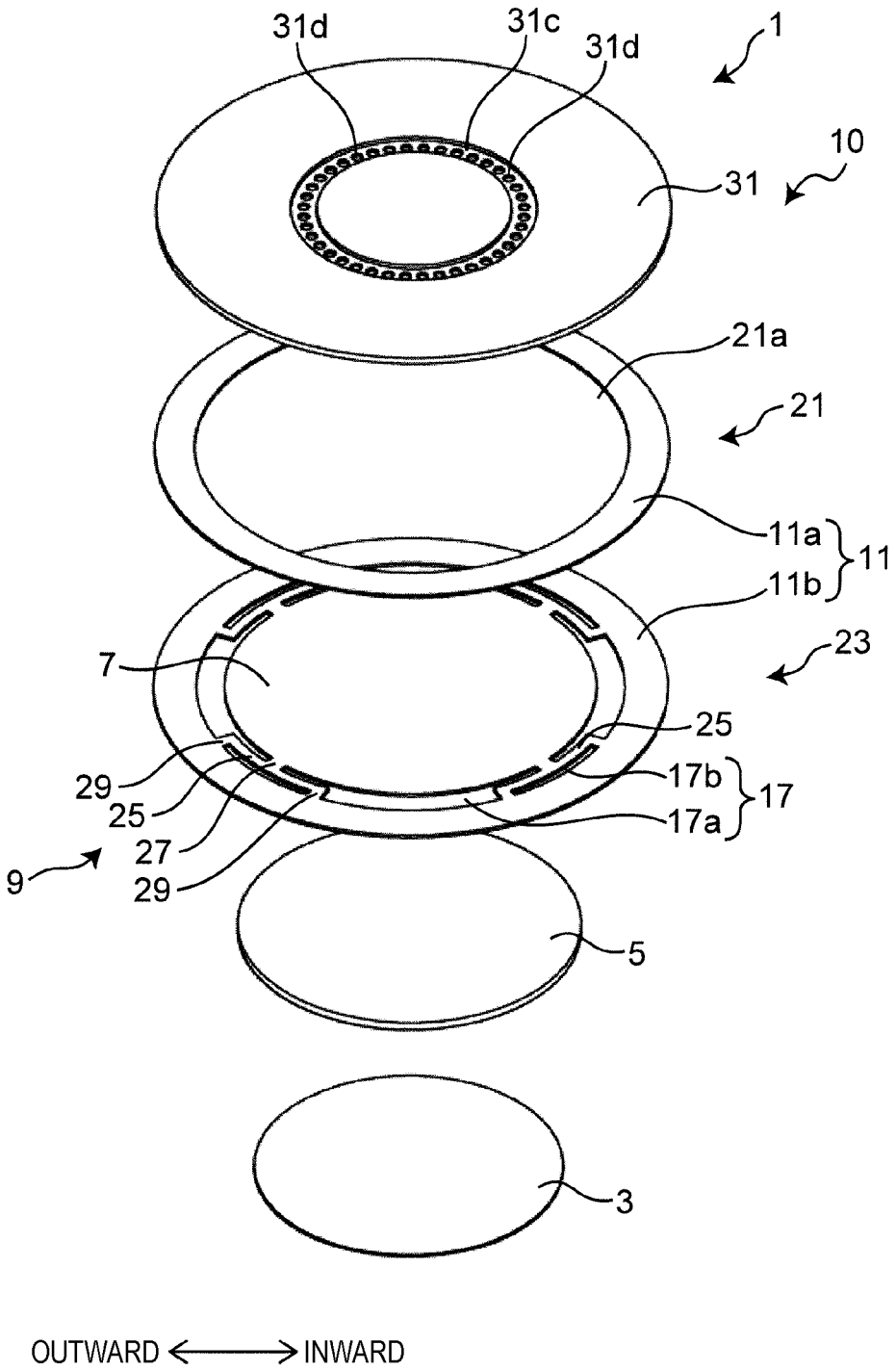
FIG. 3 is an exploded perspective view of a pump.
Figure 4:
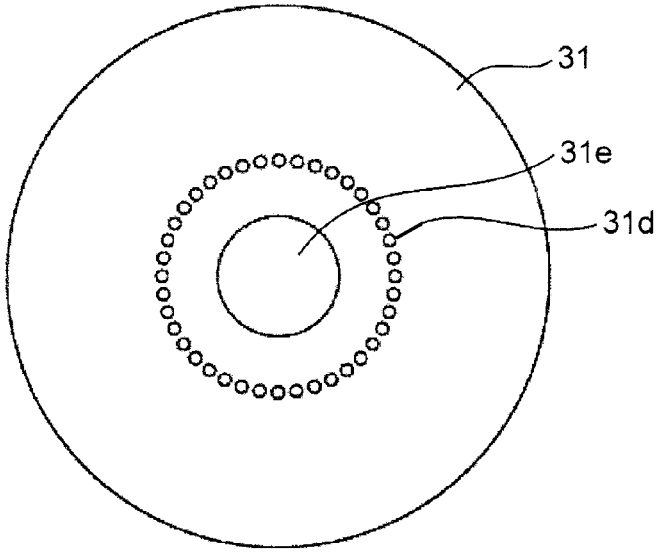
FIG. 4 is a bottom view of a top panel according to Embodiment 1.
Figure 5:
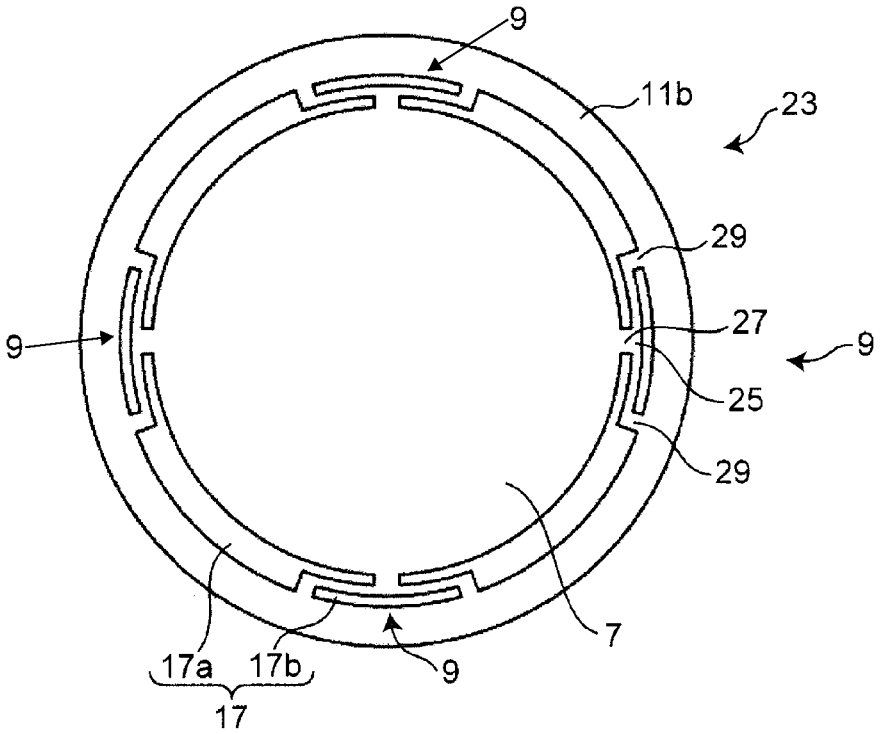
FIG. 5 is a plan view of a vibration unit.

With reference to FIGS. 3 to 5, specific configuration examples of the pump 1 according to Embodiment 1 will be further described in detail. FIG. 3 is an exploded perspective view of the pump 1. FIG. 4 is a plan view of the top panel 31 and the side wall 11 viewed from the vibrating plate 7. FIG. 5 is a plan view of a vibration unit 23.

The pump 1 includes the piezoelectric body 3, an auxiliary plate 5, the vibration unit 23, a side wall plate 21, and the top panel 31, which are multiple plates laminated in order. The entire thickness of the pump 1 is, for example, approximately 1 mm.

The auxiliary plate 5 is disposed between the piezoelectric body 3 and the vibrating plate 7. The upper surface of the auxiliary plate 5 is bonded to the lower surface of the vibrating plate 7 at the center portion. The pump 1 may not include the auxiliary plate 5.

The side wall plate 21 has a circular opening 21*a* that forms the pump chamber 15, and a side wall portion 11*a* that surrounds the opening 21*a*.

The vibration unit 23 includes the vibrating plate 7, the support portions 9, a side wall portion 11*b*, and the second cavities 17. The vibrating plate 7 has, for example, a circular shape when viewed in a plan, and is located at the center of the vibration unit 23. Instead of the circular shape, the vibrating plate 7 may be rectangular. The side wall portion 11*b* has a frame shape when viewed in a plan, and is disposed around the vibrating plate 7. The support portions 9 each include a beam portion 25 with a beam shape extending along the outer peripheral edge of the vibrating plate 7 to couple the vibrating plate 7 and the side wall portion 11*b* together. The vibrating plate 7 is disposed to have its center CL opposing the hollow 31*e* of the top panel 31. The side wall portion 11*a* of the side wall plate 21 and the side wall portion 11*b* of the vibration unit 23 form the side wall 11.

Three or more support portions 9 are included in the vibration unit 23 and arranged at intervals interposed therebetween. Each of the support portions 9 includes the beam portion 25 with a beam shape, a first coupler 27 extending in the radial direction of the vibrating plate 7 to connect the beam portion 25 and the vibrating plate 7, and second couplers 29 extending in the radial direction of the vibrating plate 7 to connect the beam portion 25 and the side wall portion 11*b*. The first couplers 27 are arranged at intervals of 90°. Thus, the support portion 9 including the long rectangular beam portion 25 has higher flexibility than the vibrating plate 7, so that the outer peripheral edge of the vibrating plate 7 can vibrate. In order for the support portions 9 to have higher flexibility than the vibrating plate 7, the support portions 9 may be thinner than the vibrating plate 7, or the support portions 9 may be formed from a material more easily bendable than the material of the vibrating plate 7.

Each of the second cavities 17 includes a first through-hole 17*a* formed between the vibrating plate 7 and the side wall portion 11*b*, and a second through-hole 17*b* formed between the beam portion 25 and the side wall portion 11*b*. The first through-hole 17*a* is formed along the outer peripheral edge of the vibrating plate 7. The second through-hole 17*b* is formed along the beam portion 25. In the vibration unit 23, the first through-hole 17*a* and the second through-hole 17*b* extend through in the lamination direction.

The vibrating plate 7 has, for example, a diameter of 13 mm and a thickness of 0.5 mm. The piezoelectric body 3 has, for example, a diameter of 11 mm and a thickness of 0.05 mm. The top panel 31 has, for example, a diameter of 17 mm and a thickness of 0.25 mm. The distance between the vibrating plate 7 and the top panel 31 at the center portion is, for example, 0.15 mm.

Driving of the pump 1 will be described with reference to FIGS. 6A to 6H. FIGS. 6A to 6H are diagrams illustrating displacement of the vibrating plate while the pump 1 is in operation. When an alternating-current driving voltage is applied to an external connection terminal (not illustrated) in the pump 1, the laminated body including the piezoelectric body 3 and the vibrating plate 7 causes bending vibrations in the thickness direction in a concentric shape due to the piezoelectric body 3 being isotropically stretched in an in-plane direction. In the bending vibrations, the side wall portion 11*b* serves as a fixed portion, the center CL of the vibrating plate 7 serves as a first vibration anti-node, and the outer peripheral edge of the vibrating plate 7 serves as a second vibration anti-node. The center CL of the vibrating plate 7 and the outer peripheral edge of the vibrating plate 7 vibrate in opposite directions.

Figure 6A:
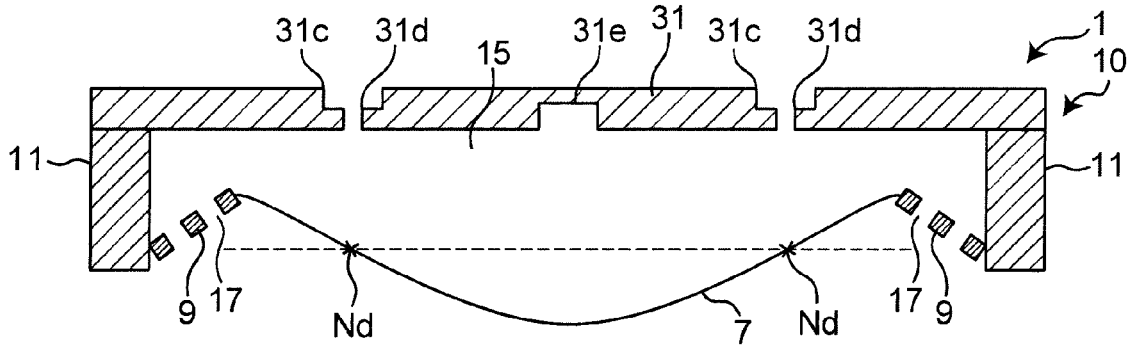
FIG. 6A is a diagram illustrating displacement of a vibrating plate while the pump is in operation.
Figure 6B:
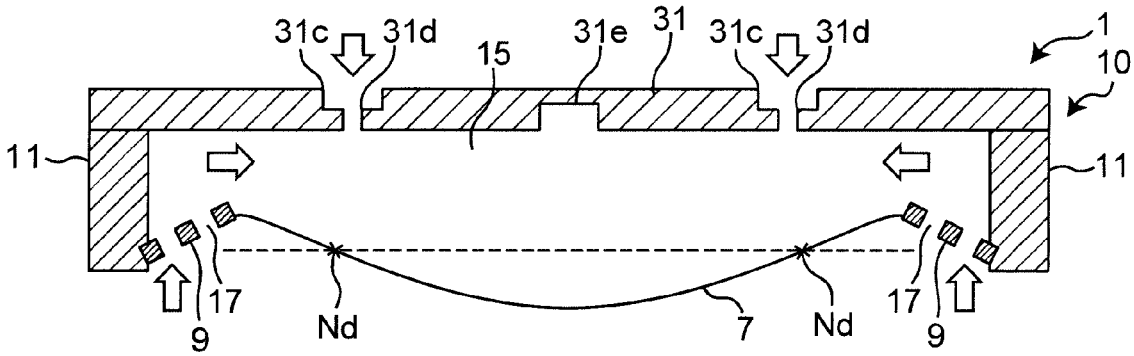
FIG. 6B is a diagram illustrating displacement of a vibrating plate while the pump is in operation.
Figure 6C:
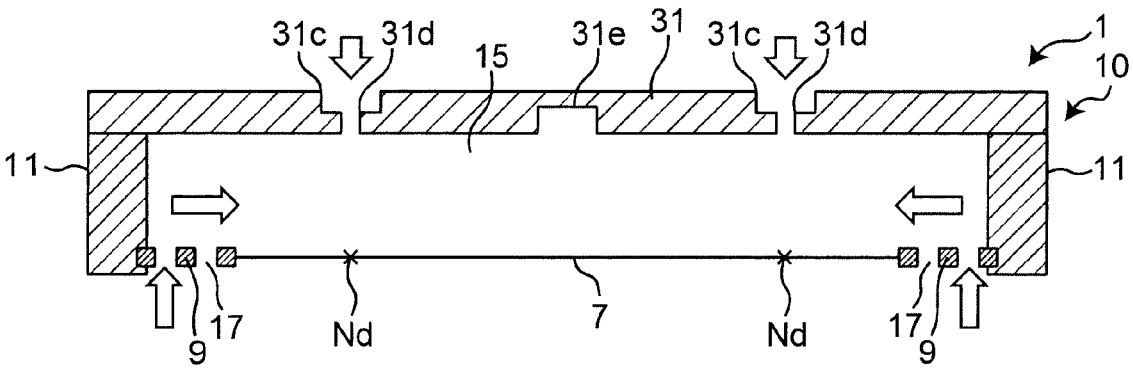
FIG. 6C is a diagram illustrating displacement of a vibrating plate while the pump is in operation.
Figure 6D:
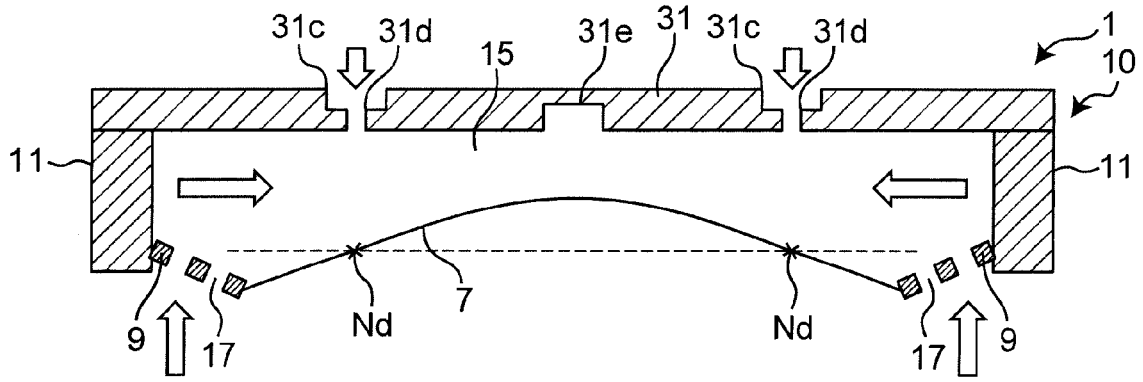
FIG. 6D is a diagram illustrating displacement of a vibrating plate while the pump is in operation.

FIG. 6A illustrates the state where the outer peripheral edge of the vibrating plate 7 is located closest to the top panel 31. Subsequently, as illustrated in FIG. 6B, when the outer peripheral edge of the vibrating plate 7 slightly moves away from the top panel 31, air flows toward the outer peripheral edge of the vibrating plate 7 through the second cavities 17. The wind speed of the incoming air lowers the static pressure at the outer peripheral edge of the vibrating plate 7, so that air flows into the pump chamber 15 through the first cavities 31*d*. FIG. 6C illustrates the state where the outer peripheral edge of the vibrating plate 7 is apart from the top panel 31 and the vibrating plate 7 and the top panel 31 are substantially parallel to each other. FIG. 6D illustrates the state where the outer peripheral edge of the vibrating plate 7 is further spaced apart from the top panel 31. The states of the pump chamber 15 in FIGS. 6C and 6D are the same as the state in FIG. 6B. Thus, also in the state in FIGS. 6C and 6D, air flows toward the outer peripheral edge of the vibrating plate 7 through the second cavities 17.

Figure 6E:
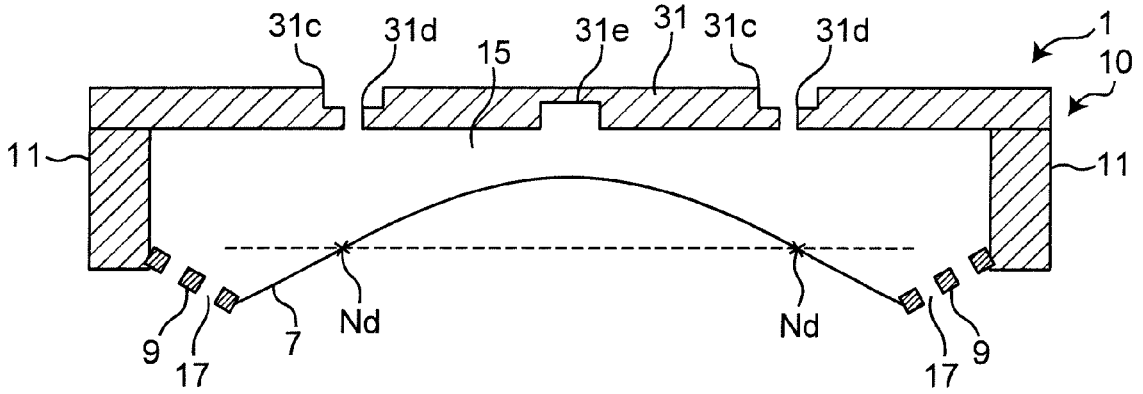
FIG. 6E is a diagram illustrating displacement of a vibrating plate while the pump is in operation.
Figure 6F:
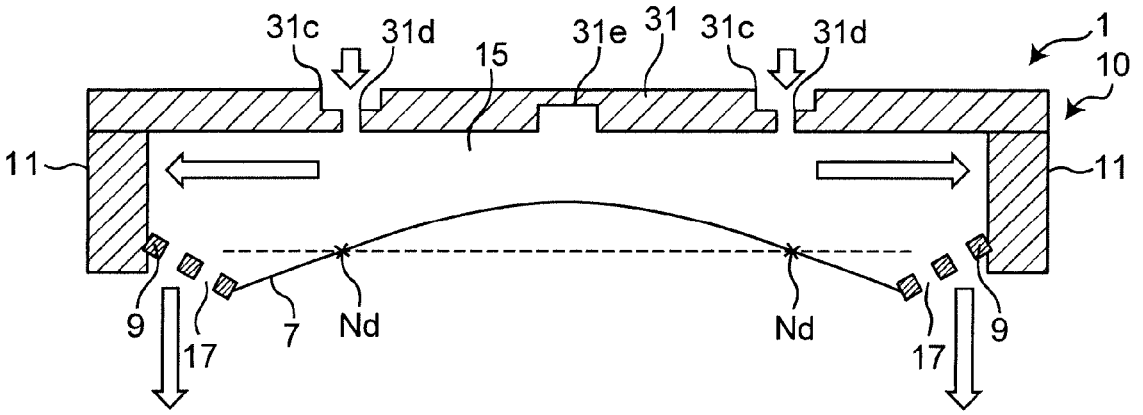
FIG. 6F is a diagram illustrating displacement of a vibrating plate while the pump is in operation.
Figure 6G:
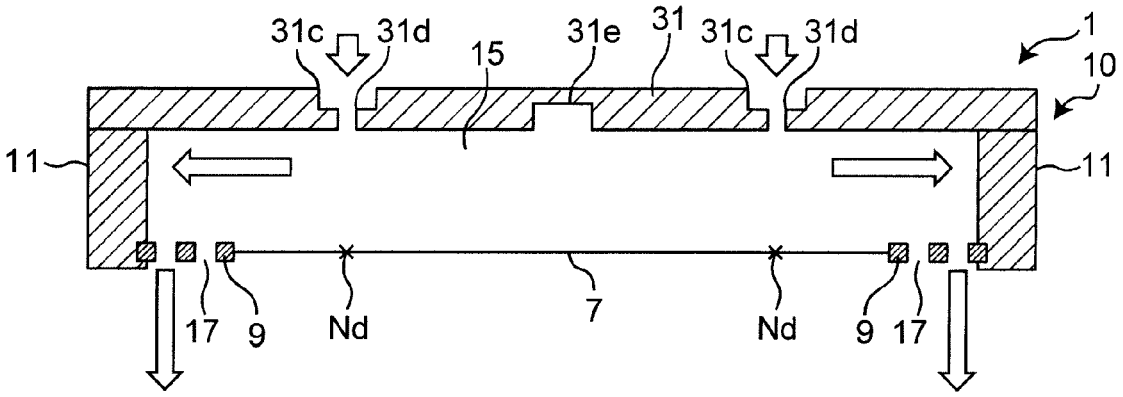
FIG. 6G is a diagram illustrating displacement of a vibrating plate while the pump is in operation.
Figure 6H:
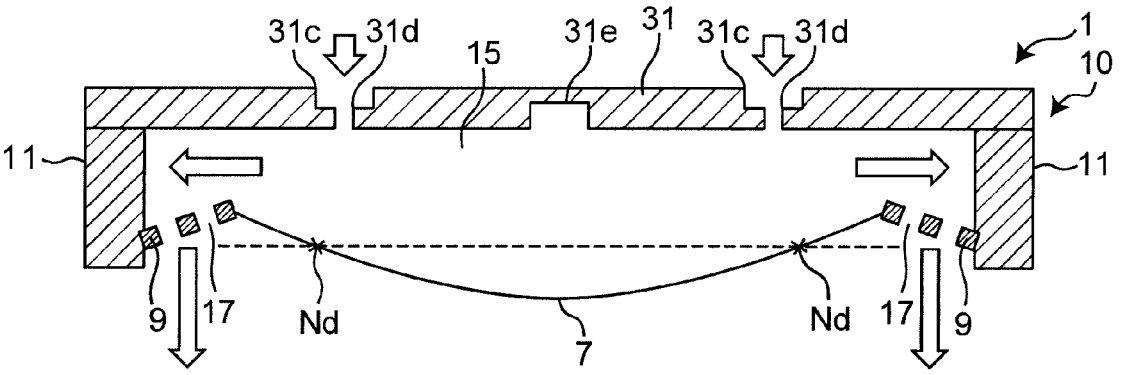
FIG. 6H is a diagram illustrating displacement of a vibrating plate while the pump is in operation.

Subsequently, after the outer peripheral edge of the vibrating plate 7 reaches the furthest position from the top panel 31 as illustrated in FIG. 6E, and then the outer peripheral edge of the vibrating plate 7 slightly moves toward the top panel 31 as illustrated in FIG. 6F, air flows out from the outer peripheral edge of the vibrating plate 7 through the second cavities 17. The wind speed of the discharged air lowers the static pressure at the outer peripheral edge of the vibrating plate 7, and air flows into the pump chamber 15 through the first cavities 31*d*. FIG. 6G illustrates the state where the outer peripheral edge of the vibrating plate 7 moves toward the top panel 31 and the vibrating plate 7 and the top panel 31 are substantially parallel to each other. FIG. 6H illustrates the state where the outer peripheral edge of the vibrating plate 7 moves further toward the top panel 31, and the pump chamber 15 illustrated in FIGS. 6G and 6H are in the same state. Thus, also in the state of FIGS. 6G and 6H, air flows out from the outer peripheral edge of the vibrating plate 7 to the second cavities 17.

As described above, in the process of repeating a cycle from FIG. 6A to FIG. 6H, and then back to FIG. 6A, air flows in through the first cavities 31*d*. In the process from FIG. 6B to FIG. 6D, air flows in through the second cavities 17, and in the process from FIG. 6F to FIG. 6H, air flows out through the second cavities 17. Here, air flows in through the first cavities 31*d*. Thus, the flow rate of air flowing out in the process from FIG. 6F to FIG. 6H is larger than the flow rate of air flowing in in the process from FIG. 6B to FIG. 6D. Thus, repeating a cycle from FIG. 6A to FIG. 6H, and then back to FIG. 6A allows air to flow in through the first cavities 31*d* and flow out through the second cavities 17.

Figure 7:
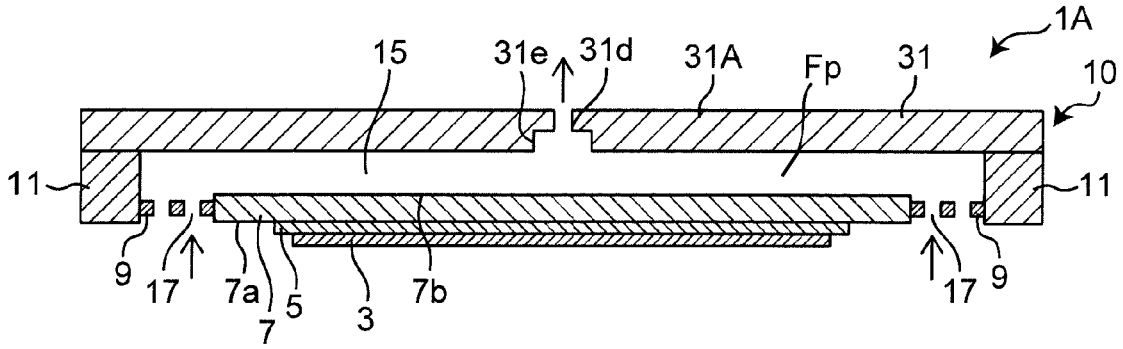
FIG. 7 is a schematic cross-sectional view of a pump according to Comparative Example 1.
Figure 8:
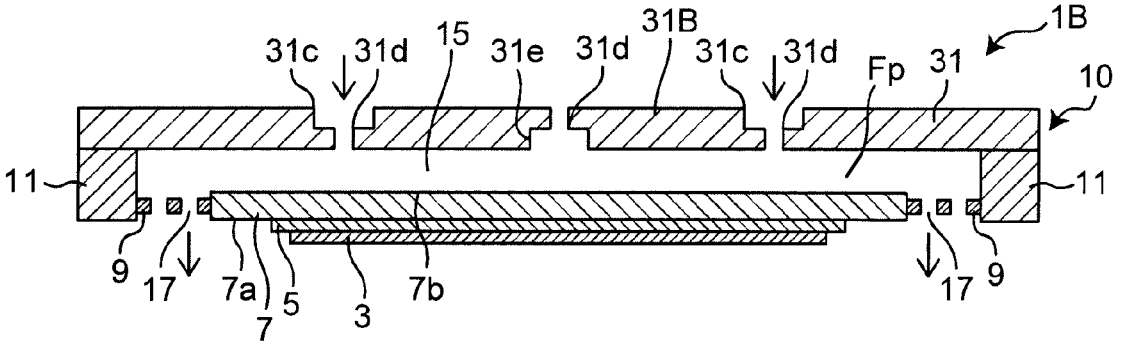
FIG. 8 is a schematic cross-sectional view of a pump according to Comparative Example 2.

With reference to FIGS. 7 and 8, the effects of the pump according to the above embodiment will be described. FIGS. 7 and 8 are schematic cross-sectional views of pumps according to Comparative Examples 1 and 2. A pump 1A illustrated in FIG. 7 includes a first cavity 31*d* at the center portion of the top panel 31. Other components of the pump 1A are the same as those of the pump 1. Unlike the pump 1 according to Embodiment 1, a pump 1B illustrated in FIG. 8 also includes a first cavity 31*d* at the center portion of the top panel 31. Other components of the pump 1B are the same as those of the pump 1.

In Embodiment 1, the first cavities 31*d* in the top panel 31 are located to oppose the portion of the vibrating plate 7 serving as the vibration node Nd. The pump 1 including the auxiliary plate 5 has its pump performance of a pump flow rate of 1.19 L/min and a pump pressure of 0.4 kPa at a driving voltage of 20 Vpp.

The pump 1A according to Comparative Example 1 illustrated in FIG. 7 has its pump performance of a pump flow rate of 0.03 L/min and a pump pressure of 0 kPa at a driving voltage of 20 Vpp.

The pump 1B according to Comparative Example 2 illustrated in FIG. 8 has its pump performance of a pump flow rate of 0.03 L/min and a pump pressure of 0 kPa at a driving voltage of 20 Vpp. Thus, the pumps 1A and 1B have the same pump performance.

Thus, the pump 1 according to Embodiment 1 has higher outputs and thus has higher performance in terms of the pump flow rate and the pump pressure than the pumps 1A and 1B according to Comparative Examples 1 and 2.

The pump 1 according to Embodiment 1 includes the vibrating plate 7 having the piezoelectric body 3 on the first main surface 7*a*, the cover 10 including the top panel 31 and the side wall 11, the top panel 31 opposing the surface of the vibrating plate 7 opposite to the first main surface 7*a*, the top panel 31 having the first cavities 31*d*, the side wall 11 being connected to the outer peripheral portion of the top panel 31 to surround the space between the top panel 31 and the vibrating plate 7, the support portions 9 connected to the side wall 11 and supporting the outer periphery of the vibrating plate 7, and the second cavities 17 formed between the side wall 11 and the vibrating plate 7. The first cavities 31*d* in the top panel 31 are located to oppose the portion of the vibrating plate 7 having a displacement amount smaller than a displacement amount of an outer peripheral edge of the vibrating plate 7. In this structure, the outer peripheral edge of the vibrating plate 7 has a large displacement, so that a fluid flows at a high speed at the outer peripheral edge of the vibrating plate 7. In contrast, at the portion of the vibrating plate 7 having a displacement amount smaller than the displacement amount of the outer peripheral edge of the vibrating plate 7, the fluid flows at a lower speed than at the outer peripheral edge. Thus, the static pressure differs between the outer peripheral edge of the vibrating plate 7 and the portion of the vibrating plate 7 having a smaller displacement amount than that at the outer peripheral edge, and the static pressure is lower at the outer peripheral edge. The first cavities 31*d* in the top panel 31 oppose the portion of the vibrating plate 7 having a smaller displacement amount than at the outer peripheral edge of the vibrating plate 7. Thus, the static pressure is lower at the outer peripheral edge of the vibrating plate 7 than at the first cavities 31*d* in the top panel 31, so that the fluid flows outward from the first cavities 31*d* in the top panel 31 to the outer peripheral edge of the vibrating plate 7. Thus, the pump can improve its performance.

The center portion and the outer peripheral edge of the vibrating plate 7 vibrate in opposite phases. The first cavities 31*d* in the top panel 31 are located closer to the portion of the vibrating plate 7 serving as the vibration node Nd than to the outer peripheral edge of the vibrating plate 7. In this structure, the center portion and the outer peripheral edge of the vibrating plate 7 vibrate in opposite phases, so that a portion of the vibrating plate 7 that serves as the node Nd that does not vibrate is located between the center portion and the outer peripheral edge. This portion of the vibrating plate 7 serving as the node Nd has substantially zero displacement amount, and the fluid has the lowest speed at this portion. Since the first cavities 31*d* in the top panel 31 are located closer to the portion serving as the vibration node Nd than to the outer peripheral edge of the vibrating plate 7, a large static pressure difference can be generated between the first cavities 31*d* in the top panel 31 and the outer peripheral edge of the vibrating plate 7, so that the fluid can flow outward at a higher flow rate from the first cavities 31*d* in the top panel 31 toward the outer peripheral edge of the vibrating plate 7.

The first cavities 31*d* in the top panel 31 may be located inward from the portion of the vibrating plate 7 serving as the vibration node Nd. This structure can achieve high pressure characteristics because of the long distance between the first cavities 31*d* in the top panel 31 and the outer peripheral edge of the vibrating plate 7.

The vibrating plate 7 has a circular shape, and the center portion and the outer peripheral edge of the vibrating plate 7 vibrate in opposite phases. The portion of the vibrating plate 7 having a smaller displacement amount than the displacement amount of the outer peripheral edge of the vibrating plate 7 is located at a position equal to or more than 45% and equal to or less than 81% of the radius of the vibrating plate 7 away from the center CL of the vibrating plate 7. In this structure, the first cavities 31*d* in the top panel 31 are located adjacent to the node Nd in the Bessel function of the first kind, so that this structure can produce a large static pressure difference.

Each support portion 9 may have a beam shape extending along the outer peripheral edge of the vibrating plate 7. In this structure, the support portion 9 can preferably enhance the flexibility further than the vibrating plate 7.

Each support portion 9 has greater flexibility than the vibrating plate 7. In this structure, the outer peripheral edge of the vibrating plate 7 increases its displacement amount, so that this structure can enhance the back-flow prevention effect, and enhance the pump flow rate and the pump pressure.

The recess 31*c* may be located outward from the first cavities 31*d* in the top panel 31 in the lamination direction of the pump 1. This structure can reduce the air resistance of a fluid flowing from the outside to the first cavities 31*d* in the top panel 31 without disturbing the air current inside the first cavities 31*d*.

The hollow 31*e* may be formed at the center portion of the top panel 31 in the surface facing the vibrating plate 7. In this structure, the distance between the vibrating plate 7 and the top panel 31 at the center portion of the vibrating plate 7 having the largest vibration displacement is longer than the distance at the other portion. This structure can thus reduce the air resistance and increase the vibration displacement. Thus, the pump flow rate and the pump pressure can be increased.

The auxiliary plate 5 may be held between the vibrating plate 7 and the piezoelectric body 3. In this structure, the vibrations of the vibrating plate 7 can be further amplified. Thus, the static pressure difference can be increased, and the pump flow rate and the pump pressure can be enhanced.

Embodiment 2

Figure 9:
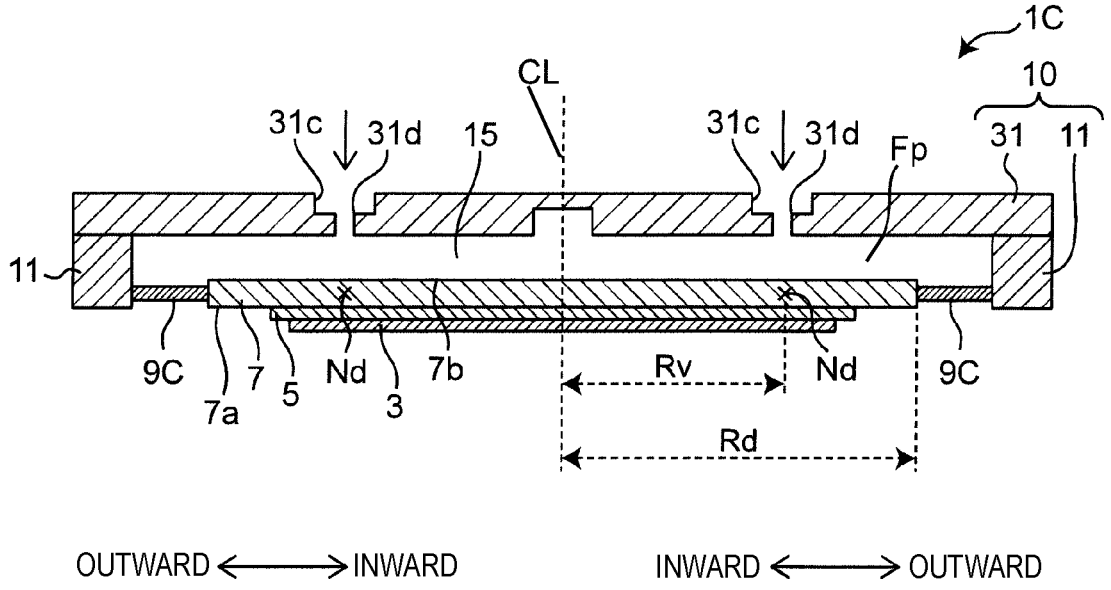
FIG. 9 is a schematic cross-sectional view of a pump according to Embodiment 2.

A pump 1C according to Embodiment 2 of the present disclosure will be described with reference to FIG. 9. FIG. 9 is a schematic cross-sectional view of the pump 1C according to Embodiment 2.

The pump 1C according to Embodiment 2 has a support portion 9C that is thinner than the vibrating plate 7. The pump 1C according to Embodiment 2 differs from the pump 1 according to Embodiment 1 in this point. Except for this point and the points described below, the pump 1C according to Embodiment 2 has the same structure as the pump 1 according to Embodiment 1. Although FIG. 9 does not include illustration of the second cavities 17, the second cavities 17 are formed in the support portion 9C.

In the pump 1C according to Embodiment 2, the support portion 9C is thinner than the vibrating plate 7. Thus, even when, for example, the support portion 9C and the vibrating plate 7 are formed from the same material, the support portion 9C may preferably have greater flexibility than the vibrating plate 7. For example, the vibrating plate 7 has a thickness of 0.40 mm, whereas the support portion 9C has a thickness of 0.10 mm.

Embodiment 3

Figure 10A:
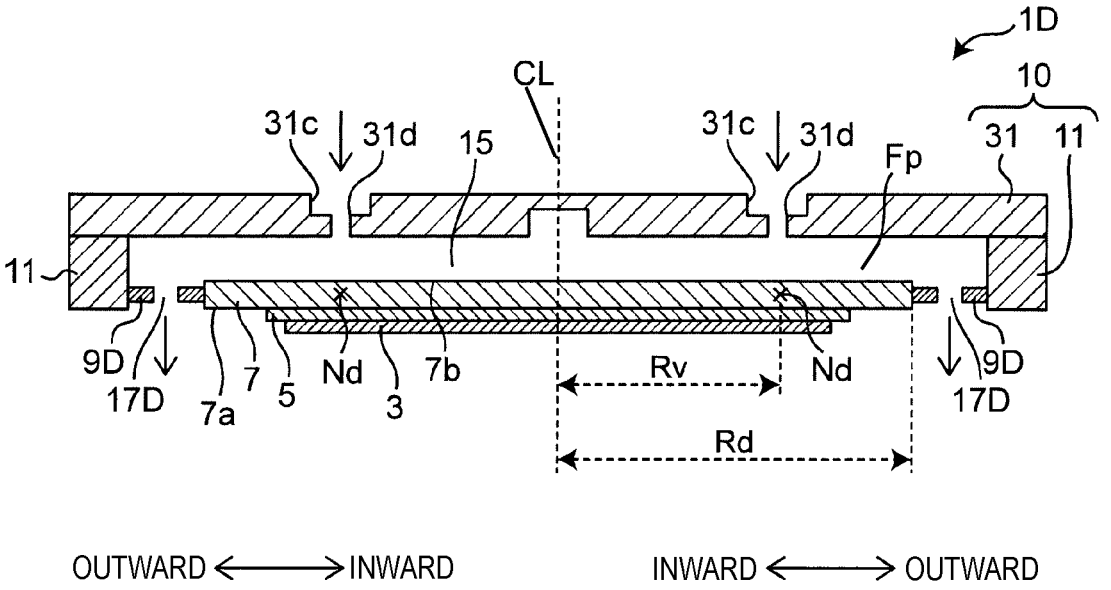
FIG. 10A is a schematic cross-sectional view of a pump according to Embodiment 3.
Figure 10B:
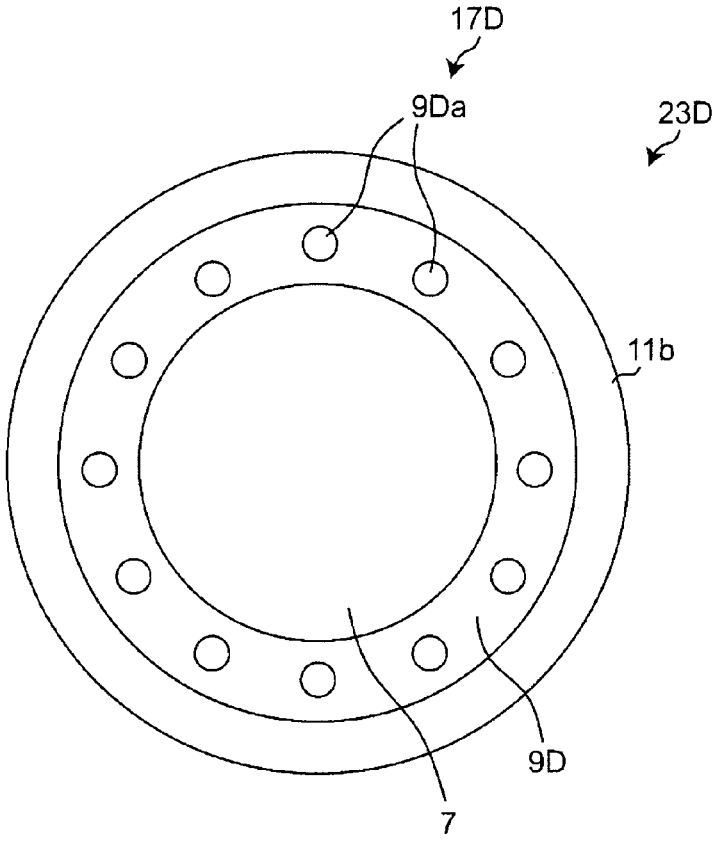
FIG. 10B is a schematic cross-sectional view of a pump according to Embodiment 3.

A pump 1D according to Embodiment 3 of the present disclosure will be described with reference to FIGS. 10A and 10B. FIG. 10A is a schematic cross-sectional view of the pump 1D according to Embodiment 3. FIG. 10B is a plan view of a vibrating plate unit 23D of the pump 1D according to Embodiment 3.

In the pump 1D according to Embodiment 3, the vibrating plate 7 and a support portion 9D are separate members. The pump 1D according to Embodiment 3 differs from the pump 1 according to Embodiment 1 in this point. Except for this point and the points described below, the pump 1D according to Embodiment 3 has the same structure as the pump 1 according to Embodiment 1.

The support portion 9D of the pump 1D is formed from a material having a lower modulus of elasticity than the vibrating plate 7. The support portion 9D is formed from, for example, a resin film such as polyimide. A film has a modulus of elasticity of, for example, 1 to 5 GPa, whereas the vibrating plate 7 formed from, for example, stainless steel has a modulus of elasticity of 200 GPa. As described above, the support portion 9D having a lower modulus of elasticity than the vibrating plate 7 does not firmly restrain the vibrating plate 7. This structure thus allows the outer peripheral edge of the vibrating plate 7 to vibrate intensely. The film has a thickness of, for example, 5 to 200 μm. Embodiment 1 may have this structure where the vibrating plate 7 and the support portion 9D are formed from separate members.

The support portion 9D has multiple through-holes 9Da arranged annularly to form second cavities 17D.

In the pump 1D according to Embodiment 3, the support portion 9D is connected to the outer periphery of the vibrating plate 7 throughout. This structure can thus improve the connection strength between the vibrating plate 7 and the support portion 9D, and thus can improve the durability of the support portion 9D.

In the pump 1D according to Embodiment 3, the vibrating plate 7 is formed from a metal, and the support portion 9D is formed from a resin. In this structure, the support portion 9D can preferably have higher flexibility than the vibrating plate 7.

Embodiment 4

Figure 11A:
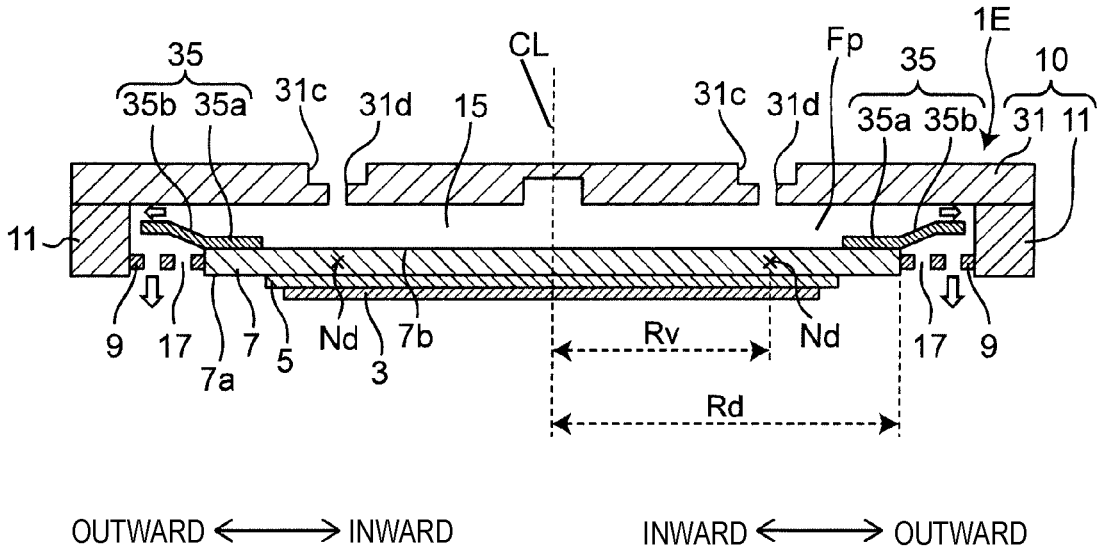
FIG. 11A is a schematic cross-sectional view of a pump according to Embodiment 4.
Figure 11B:
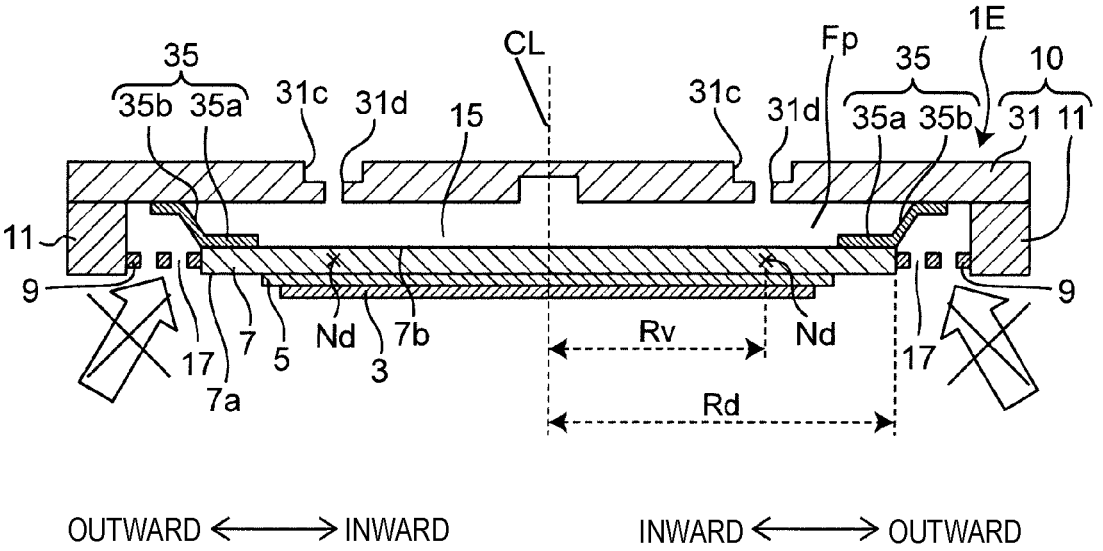
FIG. 11B is a schematic cross-sectional view of a pump according to Embodiment 4.

A pump 1E according to Embodiment 4 of the present disclosure will be described with reference to FIGS. 11A and 11B. FIG. 11A is a schematic cross-sectional view of the pump 1E according to Embodiment 4 with a valve 35 in the open state. FIG. 11B is a schematic cross-sectional view of the pump 1E according to Embodiment 4 with the valve 35 in the closed state.

In the pump 1E according to Embodiment 4, the annular valve 35 is bonded along the outer peripheral edge of the vibrating plate 7. The pump 1E according to Embodiment 4 differs from the pump 1 according to Embodiment 1 in this point. Except for this point and the points described below, the pump 1E according to Embodiment 4 has the same structure as the pump 1 according to Embodiment 1.

The valve 35 is formed from a film made from polyimide or polyethylene terephthalate (PET). The valve 35 includes an adhesive portion 35*a* bonded to the vibrating plate 7 at or around an inner peripheral portion, and a movable portion 35*b* serving as an open end at or around an outer periphery. The adhesive portion 35*a* is bonded to the surface of the vibrating plate 7 located outward from the first cavities 31*d*. The valve 35 blocks the flow from the openings of the support portions 9 to the first cavities 31*d* in the top panel 31, and allows the flow from the first cavities 31*d* in the top panel 31 to the second cavities 17 of the support portions 9. This structure prevents the back-flow from the second cavities 17 of the support portions 9, and can achieve the pump performance of high flow rate and high pressure. The valve 35 has a thickness of equal to or less than 100 μm, or more desirably, equal to or less than 10 μm. The valve 35 with a less thickness operates more effectively as a valve. To secure durability of the valve 35, the valve 35 desirably has a thickness of equal to or more than 3 μm. When the movable portion 35*b* of the valve 35 has a length in the radial direction more than the distance between the vibrating plate 7 and the top panel 31, the open end of the valve 35 overlaps with the top panel 31, so that a flow path Fp extending from the first cavities 31*d* in the top panel 31 to the second cavities 17 in the support portions 9 can be blocked. This structure can thus significantly prevent the occurrence of back-flow.

As described above, the pump 1E according to Embodiment 4 includes the valve 35 having a first portion connected to the outer peripheral edge of the vibrating plate 7 and a second portion serving as an open end. In the pump 1E according to Embodiment 4, the valve 35 has a second portion serving as an open end. Thus, when a fluid flows backward through the second cavities 17 in the support portions 9, the open end of the valve 35 stands erect toward the top panel 31, so that the flow path Fp extending from the first cavities 31*d* in the top panel 31 toward the second cavities 17 in the support portions 9 can be narrowed. This structure can thus increase the flow path resistance against the back-flow of the fluid, so that the back-flow of the fluid can be reduced by the valve 35. When a fluid flows from the first cavities 31*d* in the top panel 31 to the second cavities 17 in the support portions 9, the second portion of the valve 35 that is apart from the top panel 31 does not prevent the flow of the fluid. This structure can thus reduce back-flow of the fluid into the pump chamber 15.

The present disclosure is not limited to the above embodiments, and may be embodied in the following modifications.

Figure 12:
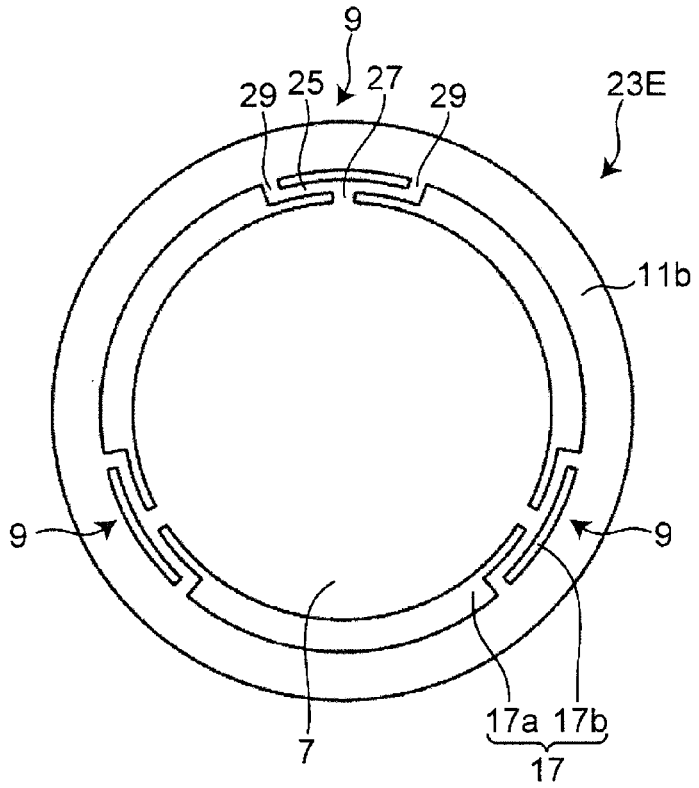
FIG. 12 is a plan view of a vibration unit according to a modification example.

(1) In each of the above embodiments, the vibration unit 23 includes four support portions 9, but this is not the only possible structure. The vibration unit 23 may have three or five or more support portions 9. As illustrated in FIG. 12, for example, a vibration unit 23E may have three support portions 9 at every 120°.

Figure 13:
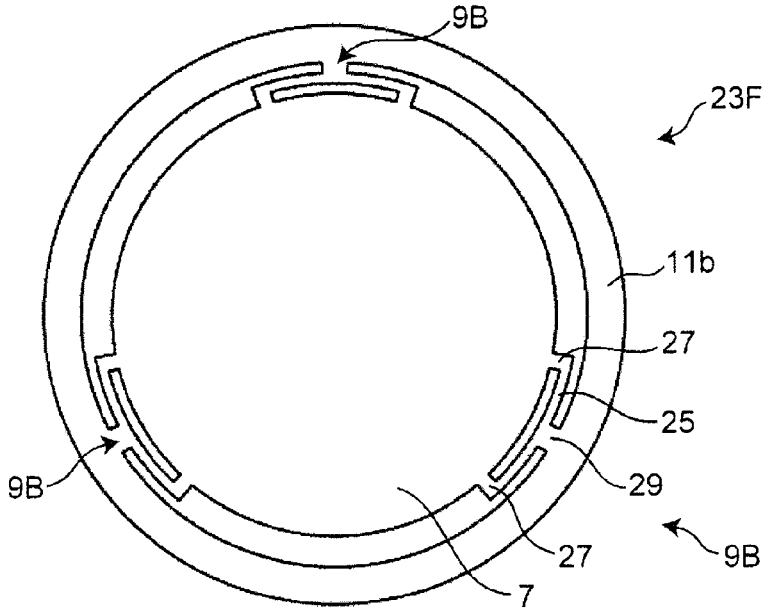
FIG. 13 is a plan view of a vibration unit according to a modification example.

(2) In each of the above embodiments, the vibration unit 23 may have the vibrating plate 7 and each of the beam portions 25 connected at two portions. As illustrated in FIG. 13, for example, in a vibration unit 23F, the vibrating plate 7 and each beam portion 25 are coupled with two first couplers 27. Each beam portion 25 and the side wall portion 11*b* may be coupled with one second coupler 29.

The present disclosure is applicable to a pump including a piezoelectric body.

1, 1A, 1B, 1C, 1D, 1E pump
3 piezoelectric body
5 auxiliary plate

7 vibrating plate
7*a* first main surface
7*b* second main surface
9, 9B, 9C, 9D support portion
9Da through-hole
10 cover
11 side wall
11*a* side wall portion
11*b* side wall portion
15 pump chamber
17, 17D second cavity
17*a* first through-hole
17*b* second through-hole
21 side wall plate
21*a* opening
23, 23B vibration unit
25 beam portion
27 first coupler
29 second coupler
31 top panel
31*a* first main surface
31*b* second main surface
31*c* recess
31*d* first cavity
31*e* hollow
33 second main surface
35 valve
CL center
Fp flow path

The invention claimed is:

1. A pump, comprising:

a vibrating plate having a piezoelectric body on a first main surface;

a cover including a top panel and a side wall, the top panel opposing a second main surface of the vibrating plate opposite to the first main surface, the top panel having a first cavity, and the side wall being connected to an outer peripheral portion of the top panel to surround a space between the top panel and the vibrating plate;

a support portion connected to the side wall and supporting an outer periphery of the vibrating plate; and a second cavity provided between the side wall and the vibrating plate in a cross-sectional view in a direction orthogonal to a direction in which the second main surface of the vibrating plate and a main surface of the top panel oppose each other, wherein the first cavity in the top panel is located to oppose a portion of the vibrating plate having a displacement amount smaller than a displacement amount of an outer peripheral edge of the vibrating plate.

2. The pump according to claim 1, wherein a center portion and the outer peripheral edge of the vibrating plate vibrate in opposite phases, and wherein the first cavity of the top panel is located closer to a portion of the vibrating plate serving as a node of vibrations than to the outer peripheral edge of the vibrating plate.

3. The pump according to claim 1, wherein the first cavity of the top panel is located in an inward direction from a portion of the vibrating plate serving as a node of vibrations.

4. The pump according to claim 1, wherein the vibrating plate is circular, and a center portion and the outer peripheral edge of the vibrating plate vibrate in opposite phases, and wherein a portion of the vibrating plate having a displacement amount smaller than a displacement amount of the outer peripheral edge of the vibrating plate is located equal to or more than 45% and equal to or less than 81% of a radius of the vibrating plate away from a center of the vibrating plate.

5. The pump according to claim 1, wherein the support portion has a beam shape extending along the outer peripheral edge of the vibrating plate.

6. The pump according to claim 1, wherein the support portion has greater flexibility than the vibrating plate.

7. The pump according to claim 1, wherein the support portion is connected to an entire circumference of the outer periphery of the vibrating plate.

8. The pump according to claim 6, wherein the support portion is thinner than the vibrating plate.

9. The pump according to claim 6, wherein the vibrating plate is composed of a metal, and wherein the support portion is composed of a resin.

10. The pump according to claim 1, further comprising a valve having one portion connected to the outer peripheral edge of the vibrating plate, and another portion serving as an open end.

11. The pump according to claim 1, wherein the top panel has a recess located in an outward direction from the first cavity.

12. The pump according to claim 1, wherein the top panel has a hollow at a center portion on a surface facing the vibrating plate.

13. The pump according to claim 1, further comprising an auxiliary plate held between the vibrating plate and the piezoelectric body.

14. The pump according to claim 2, wherein the first cavity of the top panel is located in an inward direction from a portion of the vibrating plate serving as a node of vibrations.

15. The pump according to claim 2, wherein the support portion has a beam shape extending along the outer peripheral edge of the vibrating plate.

16. The pump according to claim 3, wherein the support portion has a beam shape extending along the outer peripheral edge of the vibrating plate.

17. The pump according to claim 4, wherein the support portion has a beam shape extending along the outer peripheral edge of the vibrating plate.

18. The pump according to claim 2, wherein the support portion has greater flexibility than the vibrating plate.

19. The pump according to claim 3, wherein the support portion has greater flexibility than the vibrating plate.

20. The pump according to claim 4, wherein the support portion has greater flexibility than the vibrating plate.

* * * * *